US005334085A

United States Patent [19]

Shroff

[11] Patent Number: 5,334,085

[45] Date of Patent: Aug. 2, 1994

[54] PROCESS FOR THE MANUFACTURE OF AN IMPREGNATED CATHODE AND A CATHODE OBTAINED BY THIS PROCESS

[75] Inventor: Arvind Shroff, Paris, France

[73] Assignee: Thomson Tubes Electroniques

[21] Appl. No.: 887,663

[22] Filed: May 26, 1992

Related U.S. Application Data

[62] Division of Ser. No. 645,693, Jan. 25, 1991, abandoned.

[30] Foreign Application Priority Data

Feb. 9, 1990 [FR] France ..... 90 01518

[51] Int. Cl.[5] ..... H01J 9/04

[52] U.S. Cl. ..... 445/51; 313/346 DC

[58] Field of Search ..... 445/50, 51; 313/346 DC

[56] References Cited

U.S. PATENT DOCUMENTS

| | | | |
|---|---|---|---|
| 2,902,620 | 9/1959 | Winter | 313/346 DC |
| 2,971,246 | 2/1961 | Venema et al. | 445/51 |
| 4,850,575 | 7/1989 | Nishio et al. | 226/207 |
| 5,096,450 | 3/1992 | Sugimura et al. | 445/51 |
| 5,264,757 | 11/1993 | Snijkers | 313/346 DC |

FOREIGN PATENT DOCUMENTS

| | | | |
|---|---|---|---|
| 0028954 | 5/1981 | European Pat. Off. . | |
| 0091161 | 10/1983 | European Pat. Off. . | |
| 0298557 | 1/1989 | European Pat. Off. | 445/51 |
| 0409275 | 7/1990 | European Pat. Off. | H01J 9/04 |
| 2596198 | 9/1987 | France | 445/50 |
| WO8909480 | 10/1989 | PCT Int'l Appl. . | |
| 0528632 | 9/1976 | U.S.S.R. | 445/51 |

*Primary Examiner*—P. Austin Bradley
*Assistant Examiner*—Jeffrey T. Knapp
*Attorney, Agent, or Firm*—Joseph S. Tripoli; Dennis H. Irlbeck; Vincent J. Coughlin, Jr.

[57] ABSTRACT

The invention relates to a manufacturing process for an impregnated cathode for an electron tube and the impregnated cathode obtained in this manner. The method consists in mixing (b) a powder (Y) containing the emissive elements (generally barium and calcium aluminates) with powder (W) of at least one refractory metal (generally tungsten, if necessary mixed with a platinum ore metal), then pressing (c) this mixture into a pellet (1) which is then sintered (d) at a high temperature in hydrogen (approx. 2000° C.). In the prior art of this method, a powder of at least one refractory metal was pressed and sintered and then impregnated, machined, cleaned, etc. The process according to the invention therefore saves many steps in the manufacture of an impregnated cathode with respect to the prior art.

1 Claim, 1 Drawing Sheet

FIG_1-a
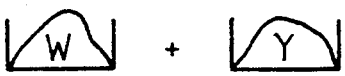
FIG_1-b
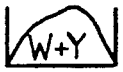
FIG_1-c
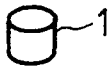
FIG_1-d
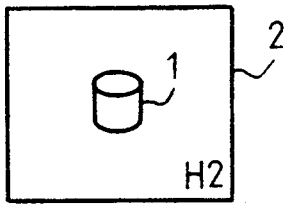
FIG_1-e
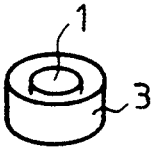
FIG_1-f
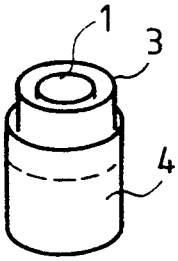
FIG_1-g
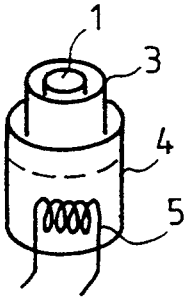
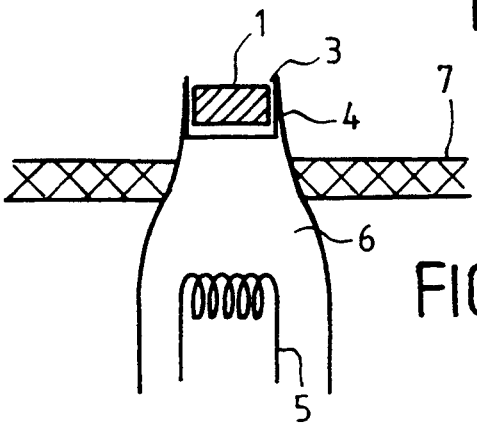
FIG_2

PROCESS FOR THE MANUFACTURE OF AN IMPREGNATED CATHODE AND A CATHODE OBTAINED BY THIS PROCESS

This application is a division of application Ser. No. 07/645,693, filed on Jan. 25, 1991, now abandoned.

BACKGROUND OF THE INVENTION

The present invention relates to a process for the manufacture of an impregnated cathode and a cathode obtained by this process. It applies to the production of cathodes for electronic tubes and more particularly but not exclusively for cathode-ray display tubes.

Impregnated cathodes are commonly used to supply electronic current densities of up to 1 or 2 $A/cm^2$ for continuous current and higher in pulse form.

In the prior art, impregnated cathodes consist of a porous body made of a refractory metal such as pure tungsten, or a mixture of tungsten with either a metal obtained from platinum ore (mixed matrix), as described in document FR A 2 356 263, or with scandium oxide or other rare earths in low concentrations of 3% to 5% by weight.

In general, this porous body is obtained by compressing a finely divided powder of the metal or a mixture of metals with an isostatic press or a single-axis press.

The compact bodies thus obtained are then heated in hydrogen at high temperatures so as to sinter the particles to one another and to increase the density of the porous body.

The porous body is infiltrated with copper or plastic to facilitate machining and then machined to the desired shape. The copper or plastic is then removed by dissolution in acid, or by heating.

The porous body of the desired shape is then brazed onto a molybdenum skirt which is used for maintaining the emissive pad on one side and, on the other, a filament potted in alumina which is used to heat the cathode. Once the filament is in position, the pores of the porous body can be filled with barium and calcium aluminares. In other words, the body is impregnated with these aluminares to form the emissive material of the finished cathode.

For this operation, the porous body is kept in close contact with an aluminate composition, which is heated to a temperature higher than its melting point in a reducing atmosphere. Contact is made either by immersing the porous body in the aluminate or by placing the aluminate on the porous body. As it melts, the aluminate is diffused into the open pores and fills them by capillary action or flowing. The cathode is then mechanically and chemically cleaned to remove any aluminate residue stuck to the surfaces.

Finally, the cathode is activated in a vacuum at a temperature at which the tungsten reduces the barium and calcium aluminate in order to liberate barium oxide. Metallic barium is produced in the zones where the aluminate is in contact with the refractory metal (pores). The metallic barium reaches the ends of the pores and is diffused over the entire emissive surface where, with oxygen, it forms a single surface coat which promotes electronic emissivity by reducing the electron work function.

In addition, a film deposit with a thickness of several thousand angstroms on the emissive surface of these impregnated cathodes and made up of osmium, iridium, ruthenium or an alloy of these bodies can improve the emissivity approximately threefold.

The mixed-matrix cathode coated with a refractory metal film is described in document FR 4 2 469 792 filed in the name of the applicant.

The performance characteristics of cathodes produced by prior art processes are satisfactory for most professional applications because high current densities can be obtained over a life span which does not limit that of the equipment in which the cathode or the electronic tube containing the cathode is installed.

However, the prior art processes briefly summarized above are long, complicated and costly because they include many different types of critically important steps that must be carried out correctly to ensure the quality of the finished product. This makes them prohibitively expensive for consumer applications where the price must come down as the number of cathodes produced increases.

The process described in the present invention is aimed specifically at eliminating these drawbacks. Accordingly, the invention calls for an original process which provides the advantages of impregnated cathodes but uses a much simpler procedure than those of the prior art.

SUMMARY OF THE INVENTION

In the present invention, tungsten powder or a powder made up of a mixture of tungsten and a platinum ore metal or scandium oxide or all three materials, is mixed with an aluminate, barium and calcium powder in the desired stoichiometric proportions. This mixture is then pressed into pellets and sintered in a hydrogen atmosphere at a temperature higher than that at which the aluminate melts. This produces a blank with a consistency equal to the porous body which is able to be manipulated. This is placed in a molybdenum or tantalum support by light mechanical pressing.

In one embodiment of the present invention, the mixture consists of tungsten powder or of tungsten and other materials, as described above, with barium and calcium carbonates and alumina in the desired stoichiometric proportions. This mixture is then compressed and sintered at the same temperature as before. In this manner, the aluminate forms "in situ" during sintering.

In another embodiment of the invention, the emissive surface of the pellet obtained using the process of the invention is coated with a film of osmium, iridium or rhenium in order to improve its emissive properties.

Afterwards, the filament is potted in the usual way, and the cathode is activated in the same way as before.

Thus, the present invention provides a process using simplified, shorter and less costly procedures for producing coated and uncoated impregnated cathodes with single-matrices of pure tungsten or mixed-matrices. It offers all the advantages of prior art processes but it involves significantly fewer steps. This makes it possible to obtain a finished product of equal quality with fewer critical operations and, therefore, fewer inspections.

The process described in the present invention is particularly suited to high-volume, low-cost industrial production of cathodes with a high current density and a relatively long life span, enabling their use to be considered for consumer products.

Specifically, this invention covers a manufacturing process for impregnated cathodes featuring the production of an emissive pellet by copressing and sintering a mixture of at least one refractory metal powder and a powder of barium and calcium aluminates, or barium and calcium carbonates with alumina added.

The invention also concerns an impregnated cathode obtained by implementing the procedure defined above.

The invention further concerns variants of impregnated cathodes which can be produced using the process defined above, for instance, cathodes produced according to the process described in the present invention and then coated with a film of platinum ore metal or any other arrangement to increase their electronic emissivity or to reduce their operating temperature while maintaining constant emissivity. The invention also includes impregnated cathode variants which can be produced using the invention process principle, for instance, cathodes manufactured using the invention process but with the addition of scandium oxide or rare earths as a complement to the mixing of the powder with a refractory metal and aluminates or carbonates of barium and calcium. Other variants of the invention process could easily be imagined and implemented for specific applications by one skilled in the art in order to benefit from the advantages obtained from this invention and particular advantages known elsewhere.

BRIEF DESCRIPTION OF THE DRAWINGS

The characteristics and advantages of the invention shall be made clearer from the following description and the examples which are given for illustration and do not limit the scope of the invention and with reference to the attached drawings wherein:

FIGS. 1*a*–1*g* are schematic views of the main steps in a simplified process according to the invention for the production of an impregnated cathode;

FIG. 2 represents a possible application of these cathodes as emitter for a cathode-ray tube.

DESCRIPTION OF THE PREFERRED EMBODIMENTS

FIGS. 1*a*–1*g* shows an example of an impregnated cathode produced according to the invention process. The figure illustrates the main steps.

The emissive pellet (1) is formed by conventional pressing (c) and sintering (d) of a mixture (b) made up of a powder (w) of at least one refractory metal and a powder (y) of barium and calcium aluminate or of carbonates of barium and calcium with alumina.

At least one of the initial powders (w) is a powder having known elements such as tungsten, molybdenum, tantalum, rhenium or alloys containing them, or the powder of an element capable of improving electronic emission, such as osmium, ruthenium, iridium or alloys containing at least one of these elements or, finally, a scandium oxide powder or oxide particles containing scandium.

FIG. 1 (*e*) shows an emissive pellet encapsulated in a cup which will then be set (f) in a skirt (4) of molybdenum or tantalum. All that is then necessary is to add a tungsten-rhenium filament (5) coated with an insulating film (not shown) and to maintain it in the skin (4) with alumina "potting" (6) as shown in FIG. 1 (*g*).

By way of explanation, the following parameters could be applied:

the powders to be mixed will be sieved and have a mesh size of approximately 5 to 10 microns. They will then be mixed in the desired stoichiometric proportions to obtain the qualities required for the cathode. The appropriate proportions will then be determined by experiment for a given application but could be, for instance: W=80%, $Sc_2O_3$=2%, BaO=12%, CaO=3%, $Al_2O_3$=3%; or the tungsten powder could be replaced by a mixture of tungsten powders and another metal, for instance, W=45%, Os=35%.

The mixed powders are pressed together (c) in an isostatic or single-axis press at a pressure of approximately 10 tons per $cm^2$, for instance, in order to form a pellet.

The pellet is sintered (d) at high temperature (around 2000° C., for example) in a hydrogen atmosphere. The chosen temperature will be sufficient to reach the melting point of the aluminate contained in the pellet.

The emissive pellet obtained will then be mounted mechanically on a skirt (4) of Me or Ta, using a cup if necessary (3) into which the pellet will be inserted by light mechanical pressing.

The skirt (4) can be made integral with the assembly by crimping (f) into the cup (3).

Then, the heating filament (5), previously coated with an alumina film (not shown), can be mounted in the skirt and held in place by an alumina body (6), commonly referred to as "potting". This potting operation can be carried out, for instance, by sintering an alumina powder deposited by a suspension around the filament and inside the skirt at 1800° C. in hydrogen.

If necessary, the emissive pellet can be covered with a thin metal film having a thickness of between 10 and 30,000 Angstroms, for instance, using a metallic material selected from a group containing osmium, ruthenium, iridium and alloys containing one of these elements. This film could be deposited by conventional means such as sputtering, vacuum deposit or any other suitable method.

FIG. 2 is a schematic and sectional view of the possible assembly of a cathode manufactured according to the invention process for an application such as an electron emitter for a cathode-ray tube.

For this application, the assembled impregnated cathode shown in FIG. 1 (*g*) simply requires the addition of a support (7) to maintain the assembly at the desired point in the equipment. Since the cathode usually operates at high voltage in an electron gun, the support (7) will probably be electrically insulated and made of alumina or ceramic, for instance.

The advantage of the process according to the invention over the prior art is that it calls for considerably fewer steps and operations are less critical for product quality. This makes it possible to obtain more efficient production, combined with higher output and lower production costs per part.

The combined advantages mean that the use of these high-performance cathodes, whose prohibitive cost restricted them to professional applications in the past, may now be considered for a wider range of applications and in some cases, for consumer product applications.

I claim:

1. A process for preparing an impregnated cathode having an electron emissive surface, comprising:

a. preparing an emissive pellet by copressing a mixture of a powder having the stoichiometric proportions of about 80 wt. % of at least one refractory element or alloy selected from the group consisting of tungsten, molybdenum, tantalum, and rhenium, about 2 wt. % of a powder of an electron-emission-improving element or alloy selected from the group consisting of osmium, ruthenium, iridium, scandium and scandium oxide, and about 15 wt. % of an electron emissive material including;

1. a powder of barium and calcium aluminates, or with
2. barium and calcium carbonate to which alumina has been added, the alumina content of the electron emissive material being about 3 wt. % of said mixture, b. sintering said pellet in a hydrogen atmosphere at a temperature of about 2000° C., and c. attaching said emissive pellet to a support, said pellet having a top electron emissive surface which forms the emissive surface of said cathode.

* * * * *